United States Patent [19]

Gates

[11] 3,996,853

[45] Dec. 14, 1976

[54] STENCIL LOADING DEVICE

[75] Inventor: Albert George Ronald Gates, London, England

[73] Assignee: Gestetner Limited, London, England

[22] Filed: June 10, 1975

[21] Appl. No.: 585,719

[30] Foreign Application Priority Data

June 11, 1974 United Kingdom ..... 25931/74

[52] U.S. Cl. ..... 101/116; 101/122; 101/127.1; 101/132

[51] Int. Cl.[2] ..... B41F 15/08; B41F 15/38

[58] Field of Search ..... 101/116, 121, 122, 127, 101/127.1, 128.1, 130, 132, 132.5, 140, 141, 142

[56] References Cited

UNITED STATES PATENTS 3,570,397 3/1971 Styles ..... 101/127.1

FOREIGN PATENTS OR APPLICATIONS 178,824 8/1935 Switzerland ..... 101/116

*Primary Examiner*—Edgar S. Burr
*Assistant Examiner*—R. E. Suter
*Attorney, Agent, or Firm*—Fleit & Jacobson

[57] ABSTRACT

A stencil duplicator has a rotatable support which, in use, supports a stencil, and a feed path along which a stencil is advanced as it is loaded onto the support defined by a supporting roller spaced from the rotatable support and a smoothly arcuate guide surface extending over a considerable part of the feed path between the roller and the support. The arrangement is such that as a stencil, whose trailing part is supported by the supporting roller, is wound onto the rotatable support, it is drawn over the guide surface.

10 Claims, 2 Drawing Figures

STENCIL LOADING DEVICE

Figure 1:
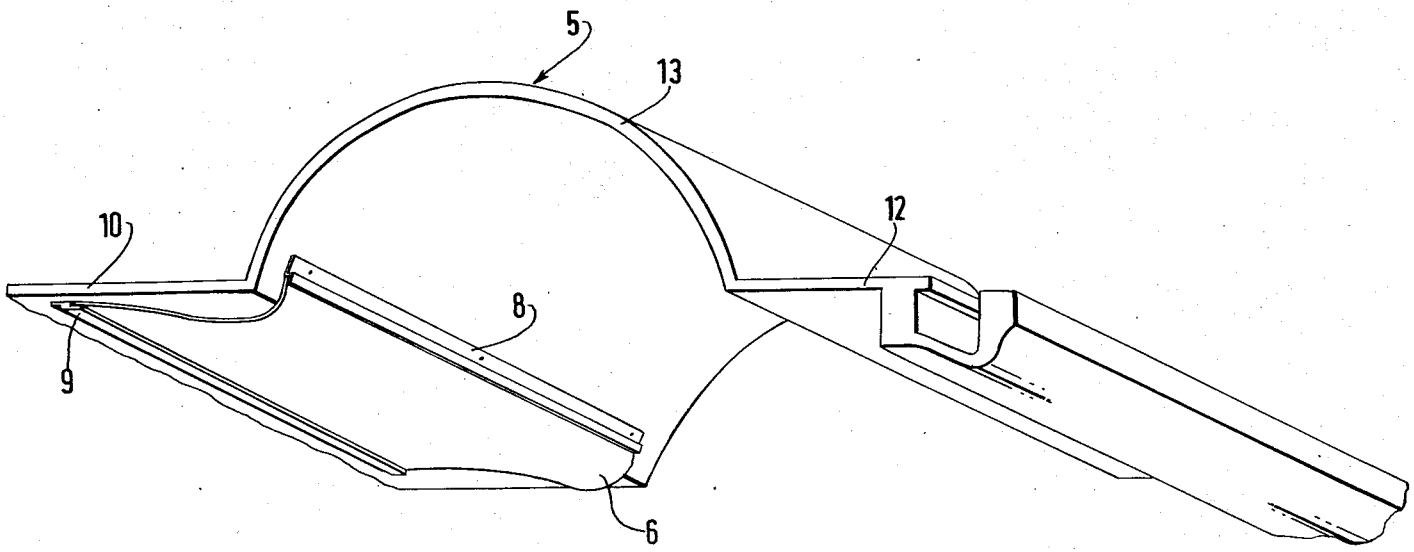

The present invention relates to a stencil loading device for a stencil duplicator.

Conventional stencils incorporate a backing sheet which must be removed from the stencil before printing can take place. Such a backing sheet serves three main purposes, namely (a) to protect and support the stencil during its preparation, (b) to protect the stencil as it is being loaded on to the duplicating machine and to assist in keeping it flat during this operation and (c) to prevent ink from the stencil from contacting the impression roller of the duplicating machine during proofing when the impression roller is employed to assist in seating the stencil on the cylinder surface. After the fitting of the stencil onto the duplicator cylinder or cylinders it is necessary to remove the backing sheet before printing can take place and this prevents the automatic loading of the stencil onto the cylinder since the backing sheet may only be easily removed with the duplicator at rest.

Described in the Applicants' British Pat. Specification No. 1,185,100 is a device for loading a stencil with its backing sheet onto a duplicating cylinder, which includes a rotatable cylindrical rod having its axis of rotation parallel to the cylinder axis and a rib on the duplicator cover adapted to be so positioned in relation to the rotatable rod that during the loading operation the rib lies below the tangential plane common to the upper surface of the duplicating cylinder and the upper part of the cylindrical rod. This apparatus is very efficient in assisting the loading of the stencil sheet onto a duplicator's cylinder with its backing still attached. However, the backing sheet must subsequently be removed after proofing of the stencil but before printing can take place. Attempting to load the stencil onto such apparatus after removal of the backing sheet requires removal of the rod by loading with the duplicator cover raised and this usually results in the stencil becoming creased, especially if the duplicator cylinder drive motor is used to assist the loading.

According to the present invention, there is provided a stencil duplicator comprising a rotatable support having a peripheral surface on which, in use of the duplicator, a stencil is carried; a guide surface arranged to define a smoothly arcuate portion of a feed path for the stencil during laying thereof onto the said support; and a rotatable supporting roller spaced from the peripheral surface of the rotatable support and having its longitudinal axis parallel to that of the rotatable support, whereby the roller may hold a stencil in contact with the guide surface during winding of the stencil onto the support and the guide surface contacts the stencil across the entire stencil width along a considerable part of the stencil feed path between the supporting roller and the surface of the rotatable support.

Preferably the guide surface is formed on a guide member fitted to a hinged cover for the duplicator, which cover suitably includes two substantially co-planar plate portions connected by a part-cylindrical portion dimensioned to fit around the adjacent part of the cylinder. The guide member may suitably be in the form of a resilient sheet, one edge of which is connected to one of the plate portion and the other edge of which is connected to the radially inner peripheral surface of the part-cylindrical portion.

Thus during loading the stencil is pulled through the nip formed between the supporting roller and the guide member and over the guide surface of the latter. This ensures that the portion of the stencil between the surface of the cylinder and the guide member surface is kept under substantially constant tension so that the stencil without its backing sheet may be applied to the surface of the cylinder.

Furthermore, by choosing a suitable material for the surface of the guide member, the stencil may be so efficiently seated on the cylinder as to ensure immediate and uniform inking of the copy sheets so that the proofing operation, which would normally be required, is no longer necessary. Such a stencil loading device allows the stencil to be loaded automatically i.e. using the drive motor of the duplicator after the leading edge thereof has been attached to the surface of the cylinder, since no additional smoothing by hand or proofing is required.

Figure 2:
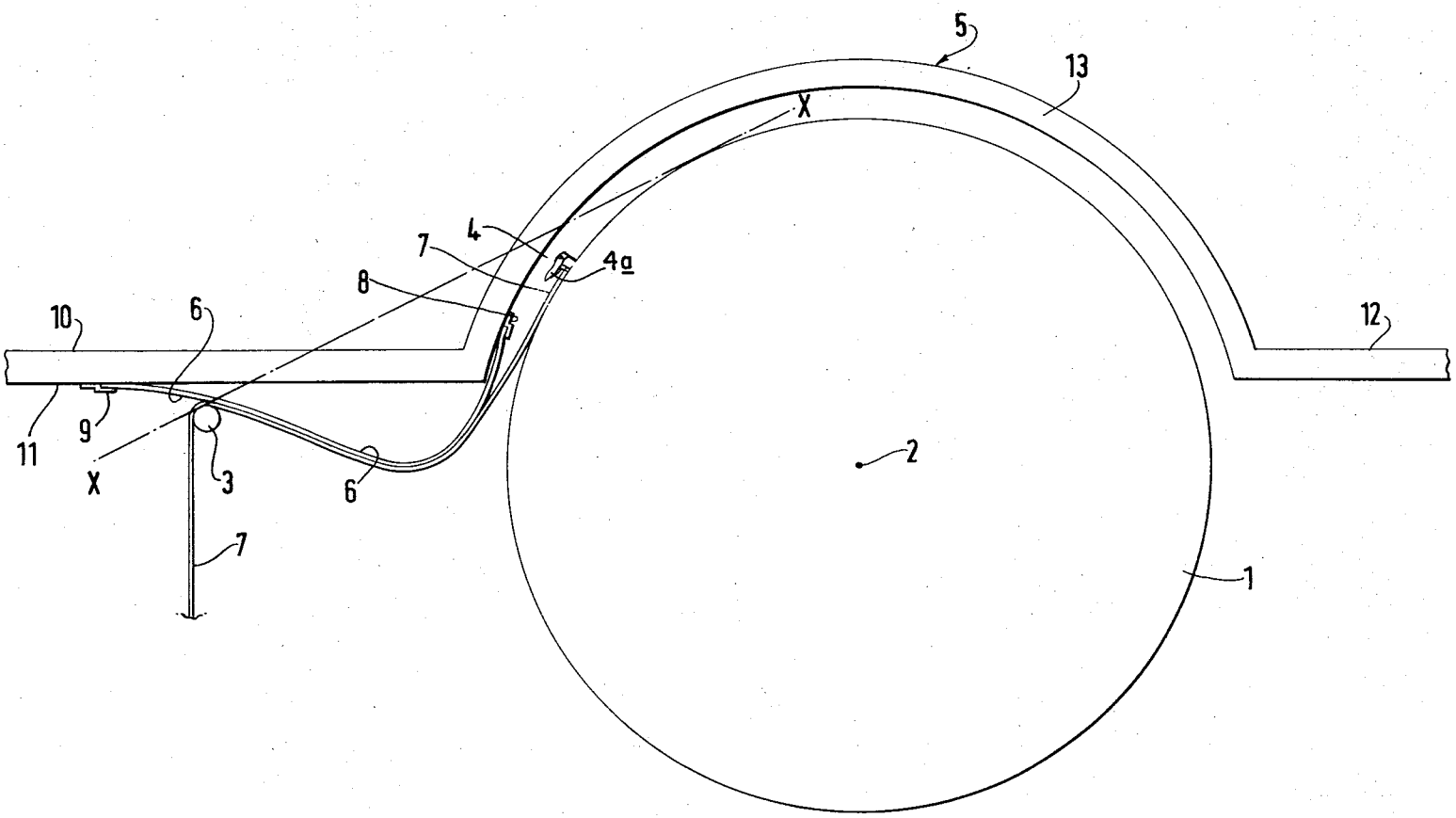

In order that the invention be more clearly understood, the following description is given, merely by way of example, reference being made to the accompanying drawings, in which:

FIG. 1 is an underneath view in perspective of a cover for a stencil duplicator for use with the invention; and FIG. 2 is a side view in section of part of a stencil duplicator embodying the invention.

Shown in FIG. 2 is a duplicator cylinder 1 rotatable about an axis 2 and mounted on a stencil duplicator frame (not shown). On the peripheral surface of the cylinder 1 is a stencil fixing bar 4 which is provided with studs which engage in holes in the leading edge of a stencil 7 and a spring flap which retains the stencil when engaged on the studs. A stencil support roller 3 is also rotatably mounted on the duplicator frame with its axis of rotation parallel to that of cylinder 1.

A top cover 5 of the duplicator includes a part-cylindrical portion 13 which fits round the cylinder 1 and two plate portions 10 and 12, which are preferably co-planar, the plate portions 12 suitably being hingedly fixed to the duplicator housing. The underneath of portion 10 provides a surface 11 which has a width somewhat greater than the maximum width of stencil to be used and extends parallel to the axis of cylinder 1.

A stencil guide member 6 is provided which is preferably in the form of a curved sheet of resilient plastics or rubber material which is attached at one of its edges to the surface 11 of plate member 10 by retaining strip 9 and to the radially inner surface of cylindrical portion 13 by retaining strip 8. The guide member 6 is such that it defines a smoothly arcuate guide surface which has a constant cross-section, extends over the width of cylinder 1 and is downwardly convex. As can be seen from FIG. 2, the radius of curvature of the surface of guide member 6 is greater than that of support roller 3 but less than that of cylinder 1. In the embodiment shown, guide member 6 has a radius of curvature which is about a quarter that of cylinder 1.

Furthermore, the guide member 6 is arranged so that it has a tangent plane near the supporting roller 3 which is closely spaced from a parallel plane which is a tangent to supporting roller 3. The portion of guide member 6 located between supporting roller 3 and cylinder 1 is contoured so that it extends below a plane X—X which is tangential to the upper portions of the surfaces, as shown in FIG. 2, of both supporting roller 3 and cylinder 1, and as can be seen from FIG. 2, the axes of rotation of the supporting roller 3 and the cylinder 1 lie to one side of this tangent plane and the centre of curvature of the guide surface of guide member 6 lies to the other.

In order to use the stencil loader, the cover 5 is folded back and the leading edge of the stencil 7 is then engaged on the stencil fixing bar 4, the spring flap 4*a* of which is then operated to clamp the leading edge of stencil 7. The remaining portion of the stencil 7 is then laid over the supporting roller 3 and the cover 5 closed. When the cover 5 is returned to its closed position, the guide member causes the portion of the stencil 7 between the supporting roller 3 and the stencil fixing bar 4 to be pushed down below the aforementioned plane which is tangential both to supporting roller 3 and to cylinder 1.

The cylinder is then caused to rotate in the clockwise direction of FIG. 2 and the stencil 7 proceeds to be wound around the surface of the cylinder 1. Rotation of cylinder 1 may be either effected manually or more preferably by operating the drive motor (not shown) for cylinder 1. The stencil 7 thus slides over the guide member 6, the sliding friction of which ensures that a constant tension exists in the portion of stencil 7 between the guide member 6 and the stencil fixing bar 4. This tension ensures that the stencil is wound onto the surface of cylinder 1 evenly and without wrinkling. Furthermore, since the guide member 6 is of constant cross-section over the width of the stencil 7, the tension in the portion of stencil 7 between the guide member 6 and the stencil fixing bar 4 does not vary over the width of the stencil 7, thereby ensuring that puckering of the stencil does not occur as it is wound on the cylinder 1.

Before being drawn over the surface of guide member 6 the trailing portion of stencil 7 comes into rolling contact with the guide roller 3, the friction therebetween and also the inertia of the roller further contributing to the constant tension in the portion of the stencil which is being wound onto the cylinder.

The material for the surface of guide member 6 may be chosen to have a suitable co-efficient of friction with the stencil so that the desired constant tension of winding up is achieved.

Using the apparatus shown, the stencil 7 is wound onto the surface of cylinder 1 smoothly and without wrinkling. Furthermore it ensures that the stencil 7 even when loaded with its backing sheet removed is so efficiently seated that the manual proofing operation which would normally be required to promote ink transfer through the stencil is not necessary.

By releasing the retaining strips 8 and 9 the guide member 6 may be easily removed to facilitate cleaning.

We claim:

1. For use in a stencil duplicator, the combination comprising a rotatable support; a peripheral surface of the rotatable support on which, in use of the duplicator, a stencil is carried; a sheet of resilient material, one surface of such sheet providing a smoothly arcuate guide surface defining a smoothly arcuate feed path for the stencil during laying of the stencil onto the said peripheral surface of the support; and a rotatable supporting roller spaced from the peripheral surface of the rotatable support and having its rotational axis parallel to that of the rotatable support, the rotatable supporting roller being positioned, in use, closely adjacent and parallel to said guide surface whereby the roller will hold a stencil in contact with the guide surface during winding of the stencil onto the support and said guide surface contacts the stencil across the entire stencil width along a considerable part of the stencil feed path between the supporting roller and the surface of the rotatable support.

2. For use in a stencil duplicator, the combination comprising a rotatable support; a peripheral surface of the rotatable support on which, in use of the duplicator, a stencil is carried; a rotatable supporting roller spaced from the peripheral surface of the rotatable support and having its rotational axis parallel to that of the rotatable support; a portion of the feed path for a stencil during laying of the stencil onto the said peripheral surface of the support extending from said rotatable supporting roller to said rotatable support; and a stationary member extending between said rotatable support and said rotatable supporting roller and defining a smoothly arcuate guide surface defining a part of said portion of the feed path, the rotatable supporting roller being positioned, in use, closely adjacent and parallel to said guide surface whereby the roller will hold a stencil in contact with the guide surface during winding of the stencil onto the support and said guide surface will contact the stencil across the entire stencil width along said part of said portion of the stencil feed path during laying of said stencil.

3. A combination according to claim 2, wherein there is an imaginary plane tangent both to the upper part of the surface of the supporting roller and to the upper part of the surface of the rotatable support, the axes of rotation of the supporting roller and rotatable support being below the tangent plane, and the centre of curvature of the guide surface being above said tangent plane.

4. A combination according to claim 2, wherein the guide surface is downwardly convex.

5. A combination according to claim 2, wherein the radius of curvature of the guide surface is smaller than that of the rotatable support but greater than that of the supporting roller.

6. A combination according to claim 2, wherein the guide surface and the supporting roller define a nip therebetween through which a stencil is drawn during laying onto said peripheral surface of the rotatable support.

7. A combination according to claim 2, wherein the guide surface is movable between a position in which stencils are loaded onto the rotatable support and an out-of-the-way position.

8. A combination according to claim 2, and comprising a sheet of resilient material, one surface of such sheet being said smoothly arcuate guide surface.

9. A combination according to claim 2, wherein the guide surface is provided on a hinged cover of the stencil duplicator.

10. A combination according to claim 9, wherein the cover comprises two spaced apart plate members and a part-cylindrical member shaped to fit around a part of the rotatable support, and interconnecting the plate members, the lid being hinged at one of the plate members and being provided with the guide surface at the other.

* * * * *